US006796037B1

(12) United States Patent
Geffers et al.

(10) Patent No.: US 6,796,037 B1
(45) Date of Patent: Sep. 28, 2004

(54) RIFLE-TYPE GUN SIGHT FOR AN ARCHERY BOW

(76) Inventors: David L. Geffers, 330 W. 18th St., Oshkosh, WI (US) 54902; Steven C. Hardel, 342 W. 18th St., Fond du Lac, WI (US) 54902

( * ) Notice: Subject to any disclaimer, the term of this patent is extended or adjusted under 35 U.S.C. 154(b) by 0 days.

(21) Appl. No.: 10/286,502

(22) Filed: Nov. 4, 2002

(51) Int. Cl.[7] ..... F41G 1/00
(52) U.S. Cl. ..... 33/265; 124/87; 124/90
(58) Field of Search ..... 33/265; 124/87, 124/90

(56) References Cited

U.S. PATENT DOCUMENTS

| | | | | | |
|---|---|---|---|---|---|
| 2,490,091 | A | * | 12/1949 | Reardon | 250/467.1 |
| 2,542,501 | A | * | 2/1951 | Fredrickson | 33/265 |
| 2,642,661 | A | * | 6/1953 | Fredrickson | 124/87 |
| 4,400,887 | A | | 8/1983 | Mason | |
| 4,745,698 | A | * | 5/1988 | Schwulst | 42/132 |
| 4,813,150 | A | | 3/1989 | Colvin | |
| 4,982,503 | A | * | 1/1991 | Land | 33/265 |
| 5,092,052 | A | * | 3/1992 | Godsey | 33/265 |
| 5,117,804 | A | * | 6/1992 | Jorlov | 124/87 |
| 5,122,932 | A | * | 6/1992 | Ziller | 362/551 |
| 5,341,791 | A | | 8/1994 | Shafer | |
| 5,517,979 | A | * | 5/1996 | Closson | 124/86 |
| 5,632,091 | A | * | 5/1997 | Brion et al. | 33/265 |
| 5,651,185 | A | | 7/1997 | Vanderheyden et al. | |
| 5,671,724 | A | * | 9/1997 | Priebe | 124/87 |
| 5,802,726 | A | * | 9/1998 | Trosper et al. | 33/265 |
| 5,864,958 | A | * | 2/1999 | Giddens | 33/265 |
| 5,920,996 | A | * | 7/1999 | Hurckman et al. | 33/265 |
| 5,975,069 | A | | 11/1999 | Hamm et al. | |
| 6,073,352 | A | | 6/2000 | Zykan et al. | |
| 6,079,111 | A | * | 6/2000 | Williams et al. | 33/265 |
| 6,199,286 | B1 | | 3/2001 | Reed, Jr. et al. | |
| 6,247,237 | B1 | | 6/2001 | Redburn et al. | |
| 6,651,350 | B1 | * | 11/2003 | Manns et al. | 33/265 |
| 6,725,854 | B1 | * | 4/2004 | Afshari | 124/87 |

* cited by examiner

*Primary Examiner*—Diego Gutierrez
*Assistant Examiner*—Amy R. Cohen
(74) *Attorney, Agent, or Firm*—Brannen Law Office, LLC

(57) ABSTRACT

The bracket of the present invention has a connection plate for mounting to the right side of the attaching section of the bow. The bracket has first and second mounting sections, which are preferably coplanar and generally lie in a plane defined by the left side of the attaching section of the bow. In a preferred embodiment, the connection plate has a curved channel formed therein. The first and second mounting sections are supported by an aiming piece, which is slideable in the curved channel of the connection plate. The end of a first fiber optic cable illuminates a pin sight mounted to the first mounting section. The ends of a plurality of second fiber optic cables illuminate a peep sight mounted to the second mounting section. A single variable resistor simultaneously varies the brightness of all fiber optic cables.

42 Claims, 6 Drawing Sheets

RIFLE-TYPE GUN SIGHT FOR AN ARCHERY BOW

FIELD OF THE INVENTION

The present invention relates to a rifle-type gun sight assembly for an archery bow having an adjustably illuminated pin sight and peep sight, both of which are mounted to a bracket, which can include a carriage slide.

BACKGROUND

Archers continually look for ways to more consistently hit the intended target. A conventional bow having an arched shape has an attaching section above a handle section. The attaching section has a right side that defines a first plane and an opposed left side that defines a second plane. A string and two cables are attached to the bow. A cable guard is sometimes connected to the right side of the attaching section of the bow, or to another section of the bow, and is used to deflect the cables to the right. A bracket for holding a sight pin is sometimes mounted to the attaching section of the bow.

Some archery bows utilize non-illuminated sight pins. One such design is shown in U.S. Pat. No. 5,651,185 to Vanderheyden. Archers may find this type of design undesirable, because of substantial difficulties in seeing non-illuminated sight pins at dusk, which is a time when many hunters prefer to hunt. The Vanderheyden patent also discloses a bow sight assembly having a forward body portion and a rearward body portion The sight assembly is mounted to one side of the bow. The forward body portion has stationary sight pins. A movable rear peep is mounted to a sight arm. The sight arm is pivotally mounted to a main sight body. An archer adjusts the sight range of the bow by adjusting the location of the peep. The rear peep moves an undesirably large amount in relation to the remainder of the bow. Further, the rear peep is farther than necessary from the sight assembly. Also, the Vanderheyden design may interfere with the use of a stabilizer mounted to the attaching section of the bow.

U.S. Pat. No. 4,400,887 to Mason discloses an archery bow sight with two sight pins. A control means causes one of the sight pins to glow so as to be distinguishable from the other pin. A rheostat allows the intensity of the sights to be varied under different light conditions.

U.S. Pat. No. 5,341,791 to Schafer shows an illuminated sighting structure. A chemiluminescent sphere mounted to a rod is at one end of a sighting tube. A chemiluminescent ring is at the other end of the sighting tube. As a modification, a fiber optic cable aids in the illumination of the chemiluminescent sphere and ring. The chemiluminescent ring and rod with a sphere mounted thereto are in a spaced relationship with a mounting plate. The mounting plate, in turn, is mounted to a bow body. However, the mounting plate is only shown mounted to the side of the bow body opposite of the side typically having holes predrilled therein. In the absence of predrilled holes, the archer must retrofit his or her bow in order to use the design shown in the Schafer patent. An outer chemiluminescent sighting ring is shown as an alternative embodiment. However, the rear ring is not vertically movable relative to the sphere.

U.S. Pat. No. 6,247,237 to Redburn et al. shows a fiber optic rod at the end of a relatively long and narrow tube. One strikingly undesirable feature of the Redburn design is that the archer can only view the target by looking around the outside of the tube. It can be difficult to aim in absence of a direct line of sight to the target, as the archer can be forced to guess where the target is. The mounting plate shown in the Redbum patent has no offset portion. Hence, the tube is further than necessary from the plate. As such, the structural rigidity of the tube is diminished. Further, portions of the bracket that extend rearwardly from the bow may interfere with the use of a cable guard.

Several other United States patents disclose sights of various shapes and sizes. Examples include: U.S. Pat. No. 4,813,150 to Colvin, U.S. Pat. No. 5,975,069 to Hamm et aL, U.S. Pat. No. 6,073,352 to Zykan et al., and U.S. Pat. No. 6,199,286 to Reed, Jr. et al. The designs in each of these patents are undesirably complicated.

Hence, a need exists for a design that solves these and other problems.

SUMMARY OF THE INVENTION

The present invention relates generally to a sight assembly with a bracket, a pin sight and a peep sight for use with a conventional archery bow.

A conventional archery bow has a top and a bottom with a handle section and an attaching section therebetween. The attaching section is above the handle section. The attaching section has a right side that defines a first plane and a left side that defines a second plane. Holes are typically predrilled into the right side of the attaching section. An arrow is usually projected from the left side of the attaching section of the bow. A string and two cables span between the bow's top and bottom. A cable guard, which is often connected to the right side of the attaching section of the bow, deflects the cables.

According to one aspect of the present invention, a first preferred bracket embodiment is provided. The bracket has a connection plate with holes therethrough for mounting to the right side of the attaching section of the bow. Two legs are provided to offset a first and a second mounting plate, respectively, from the connection plate. The first and second mounting plates are preferably coplanar and generally lie in the second plane defined by attaching section of the bow. Each mounting plate has holes formed therethrough.

A pin sight is mounted to the first mounting plate. The end of a fiber optic cable illuminates the pin sight.

A peep sight is mounted to the second mounting plate. In carrying out my invention, ends of multiple fiber optic cables are positioned in a circular pattern around the peep sight. The ends of the fiber optic cables illuminate the peep sight.

A variable resistor with a switch is provided to adjust the brightness of the ends of the fiber optic cables in the pin sight and peep sight. In accordance with the present invention, a single variable resistor communicates with all the fiber optic cables simultaneously to vary their respective brightness. At dusk, when very little brightness is desired, or whenever the ambient lighting conditions warrant, the variable resistor allows the archer to tone down the brightness to an acceptable level so that the archer can still see the pin sight and peep sight, but the brightness is not overpowering. One preferred type of variable resistor is a rheostat.

According to another aspect of the present invention, a second bracket embodiment is provided. A connection plate with a curved channel therein is attached to the right side of the attaching section of the bow. The curvature of the connection plate channel has a radius that is approximately equal to the length of a human arm, or approximately 18 to 36 inches.

An aiming piece is provided comprising a carriage slide and a mounting beam. The carriage slide is curved to fit within the curved channel of the connection plate. A thumbwheel or the like is provided to selectably move the carriage slide up and down within the connection plate channel. The thumbwheel is manipulable both before and while the string is drawn. The mounting beam is on top of the carriage slide and has a forward end and a rearward end. The forward end comprises a first mounting plate and the rearward end comprises a second mounting plate. The mounting beam can be a bent beam, such that the forward and rearward ends of the mounting beam are offset from the remainder of the mounting beam. The forward and rearward ends preferably lie in the second plane defined by the attaching section of the bow. The pin sight is mounted to the mounting beam near its forward end, and the peep sight is mounted to the mounting beam near its rearward end. The variable resistor can be enclosed within the mounting beam or attached to the exterior of the mounting beam.

The forward and rearward ends of the mounting beam simultaneously move up and down in a predetermined ratio in response to the archer manipulating the thumbwheel. Hence, the pin sight and peep sight also simultaneously move up and down in a predetermined ratio. The pin sight preferably moves up 1 inch for every corresponding ¾ inch of movement of the peep sight, given a 7 inch spacing center to center between the pin sight and peep sight. The archer's shoulder is approximately at the center of the rotation of arcuate movement of the pin sight and peep sight.

The bow is aimed by aligning the archer's eye with the peep sight, the pin sight, and the target in a direct line of sight. In this regard, the archer maintains a clear view of the target and of the surroundings. The risk that the archer would fail to see a potential hazard is therefore minimized.

Other advantages, benefits, and features of the present invention will become apparent to those skilled in the art upon reading the detailed description of the invention and studying the drawings.

DETAILED DESCRIPTION OF THE PREFERRED EMBODIMENTS

While the invention will be described in connection with preferred embodiments, it will be understood that it is not intended to limit the invention to these embodiments. On the contrary, it is intended to cover all alternatives, modifications and equivalents as may be included within the spirit and scope of the invention as defined by the appended claims.

The embodiments of the present invention described herein are described in relation to a conventional right-handed archery bow. However, a conventional left-handed archery bow is merely a mirror image of a right-handed bow. Thus, it is readily contemplated that the design of the embodiments described herein can be modified to enable the respective embodiments to be used with a left-handed bow merely by creating the embodiment's mirror images.

Figure 1:
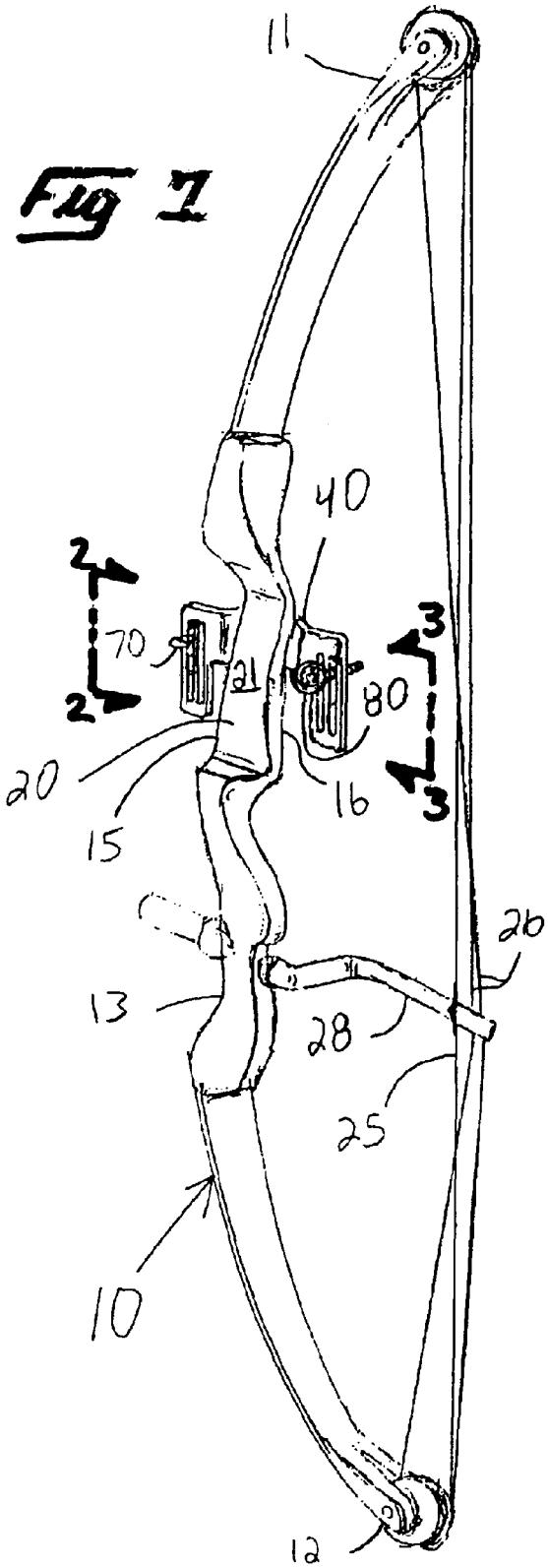
FIG. 1 is a perspective view of the present invention shown mounted to a conventional bow.
Figure 2:
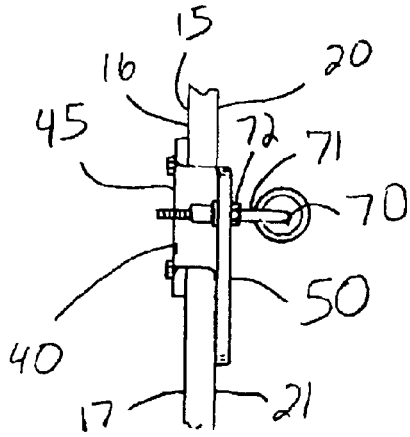
FIG. 2 is a front view taken along line 2—2 in FIG. 1.
Figure 7:
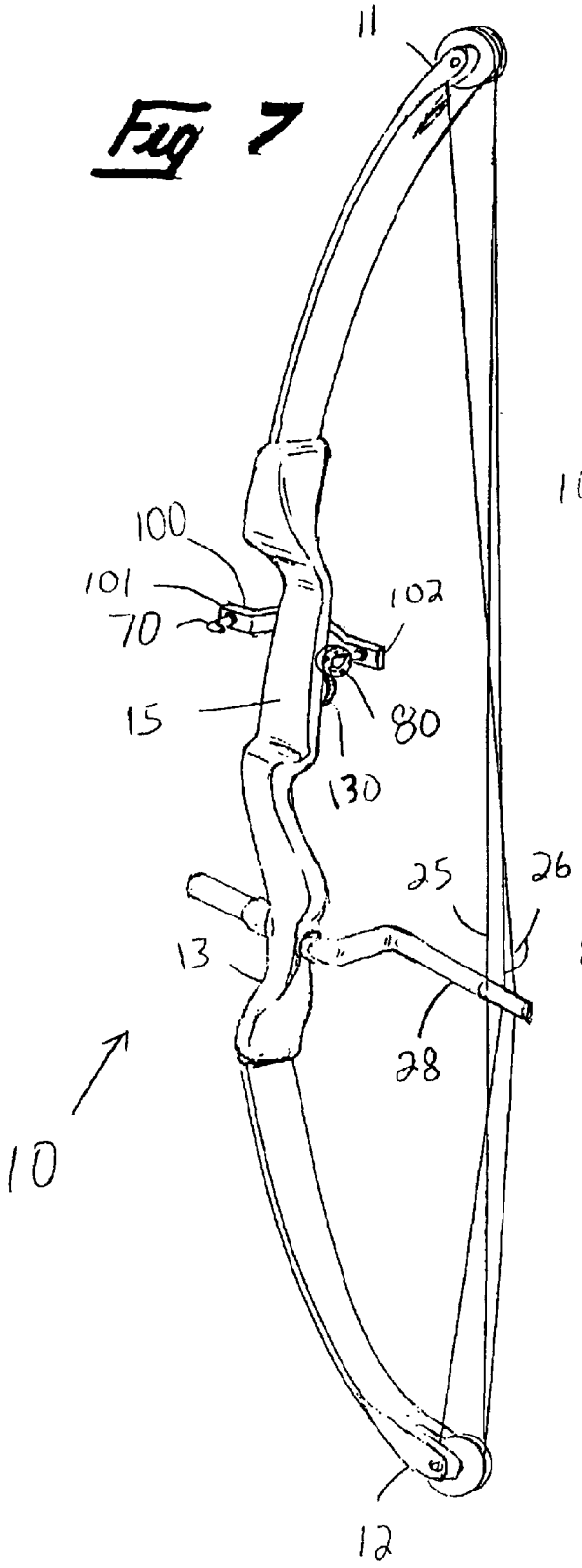
FIG. 7 is a perspective view of an alternative embodiment of the bracket of the present invention with a pin sight and a peep sight mounted thereto.

Referring to FIGS. 1 and 7, a conventional bow 10 has a top 11 and a bottom 12. A handle section 13 is between the top 11 and bottom 12. An attaching section 15 is above the handle section 13. As shown in FIG. 2, the attaching section 15 has a right side 16 defining a first plane 17 and an opposed left side 20 defining a second plane 21. Holes 18 are predrilled into the right side 16. An arrow guide (not shown) is often located on the left side 20 of the attaching section 15. Hence, the left side 20 of the attaching section 15 is sometimes called the arrow side. An archer 5, shown in FIG. 12, pulls a string 25 to draw an arrow (not shown) back to its drawn position. The archer 5 releases the string 25 to project the arrow from the bow 10. Two cables 26 are used to tension the string 25. The cables 26 span between the top 11 and bottom 12 of the bow 10. A cable guard 28 is often attached to the right side of the bow 10 to deflect the cables 26 so that they do not interfere with the projection of the arrow. In FIG. 1, the cable guard 28 is shown attached to the handle section 13 of the bow 10.

Figure 5:
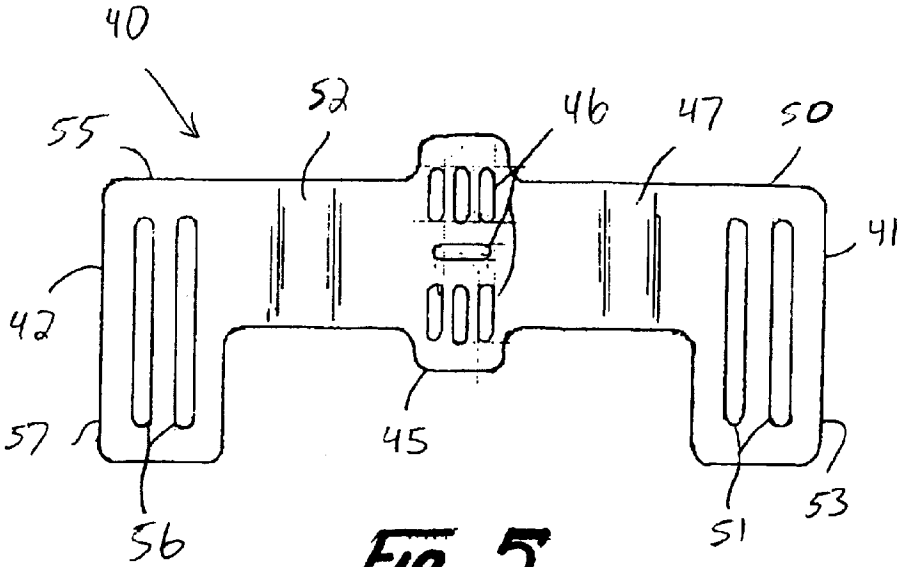
FIG. 5 is a side view of the bracket of the present invention.

In accordance with one aspect of the present invention as shown in FIGS. 1–6, a rifle type gun sight having a bracket 40 is provided. The bracket 40 is preferably about ⅛ inch thick, and has a front section 41 and a rear section 42. A connection plate 45 is between the front section 41 and rear section 42 of the bracket 40. One or more holes 46 are through the connection plate 45, as best shown in FIG. 5. Holes 46 are preferably slots, which can be oriented either vertically or horizontally. The bracket 40 is in operative association with the bow 10, such that the holes 46 are alignable with the holes 18 that are predrilled into the right side 16 of the attaching section 15 of the bow 10. A first leg 47 is at the front of the connection plate 45 and is preferably outwardly angled 45 degrees therefrom. A first mounting plate 50 is forward of the first leg 47, and inwardly angled 45 degrees relative to the first leg 47. Hence, the first mounting plate 50 is parallel to, but offset from, the connection plate 45. One or more holes 51 are through the first mounting plate 50. A second leg 52 is at the rear of the connection plate 45 and is preferably outwardly angled 45 degrees relative to the connection plate 45. A second mounting plate 55 is rearward of the second leg 52, and inwardly angled 45 degrees therefrom The second mounting plate 55 is generally parallel to and is preferably coplanar with the first mounting plate 50. One or more holes 56 are through the second mounting plate 55. Holes 51 and 56 are preferably slots, and are oriented vertical with respect to the remainder of the bracket 40. There are preferably two slots through each of the first and second mounting plates 50 and 55. However, the mounting plates 50 and 55 can be enlarged to accommodate more than two slots without departing from the broad aspects of the invention. The first and second mounting plates 50 and 55 are preferably offset approximately ½ inch from the connection plate 45. In a preferred embodiment, the mounting plates 50 and 55, the legs 47 and 52 and the connection plate 45 are integral with each other, such that the bracket 40 is comprised of a single piece of material that is bent into the desired shape.

Figure 4:
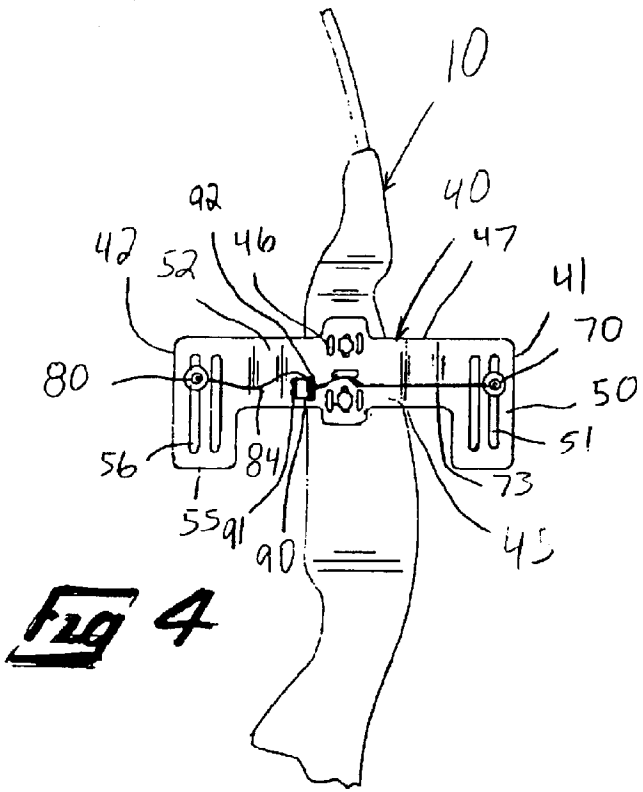
FIG. 4 is a right side view showing the present invention mounted to the right side of the attaching section of a conventional bow.

The bracket 40 is mounted to the attaching section 15 of the bow 10, and preferably to the right side 16 of the attaching section 15, as shown in FIG. 4. The holes 46 of the connection plate 45 are aligned with the holes 18 predrilled into the right side 16 of the attaching section 15. The preferred slotted shape of the holes 46 allows great flexibility in mounting the bracket 40 to the bow 10. Screws are used to fasten the connection plate 45 in place. Flat head screws are preferably used because their heads are flush with the surface of the bracket 40 and are thus unobtrusive. With the bracket 40 in place, the first and second mounting plates 50 and 55 are generally coplanar with the left side 20 of the attaching section 15 and lie in the second plane 21. Due to the offset mounting plates 50 and 55, the bracket 40 can be used simultaneously with a cable guard 28 even when the cable guard 28 is attached to the right side 16 of the attaching section 15 of the bow 10.

To provide even more flexibility, the first and second mounting plates 50 and 55 have ears 53 and 57, respectively. The ears 53 and 57 are shown in FIG. 5 to extend downward. However, the bracket 40 can be mounted to the bow 10 in an orientation (not shown) where the ears extend upward. Also, as the mounting plates 50 and 55 could each have ears that extend upwards and downwards (not shown).

Figure 3:
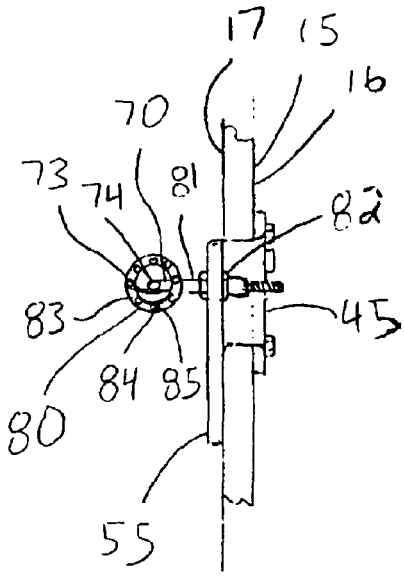
FIG. 3 is a rear view taken along line 3—3 in FIG. 1.
Figure 6:
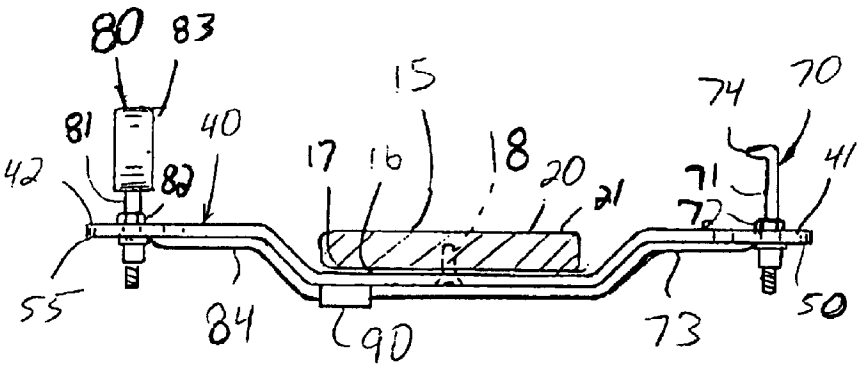
FIG. 6 is a top view of the present invention mounted to a bow and showing the use of a single variable resistor.

A pin sight 70 is provided with a shaft 71 that is threaded to receive one or more nuts 72. One end of the pin sight 70 is preferably inwardly bent. A fiber optic cable 73 having an end 74 is provided to fit within and to illuminate the bent end of the pin sight 70. The pin sight 70 is mounted to the first mounting plate 50, as shown in FIGS. 2, 3 and 6. The shaft 71 is inserted through one of the holes 51 in the first mounting plate 50. The nuts 72 adjustably secure the shaft 71 in place. The user can hence vary the effective length of the shaft 71 to suit the user's particular preferences.

Figure 14:
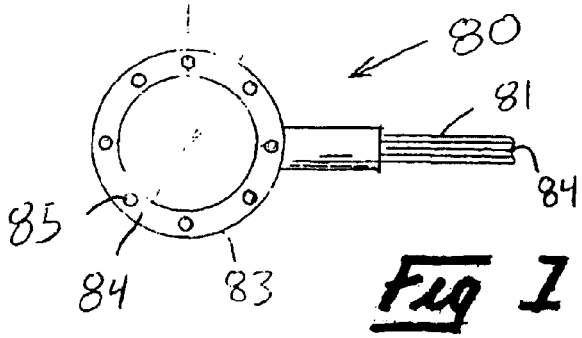
FIG. 14 is a rear view of the peep sight showing the ends of eight fiber optic cables arranged in a circle.
Figure 15:
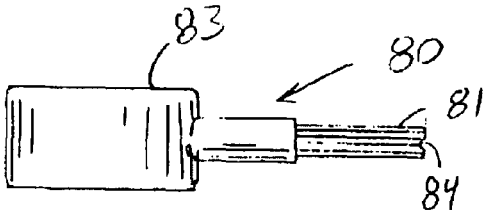
FIG. 15 is a top view of FIG. 14.

A peep sight 80 is provided with a shaft 81 that is threaded to receive one or more nuts 82. The peep sight 80 has a ring 83 that is preferably circular. The ring 83 preferably has an inside diameter of approximately ⅜ inch, and an outside diameter of approximately ½ inch, as shown in FIG. 14. Hence the thickness of ring 83 is approximately ⅛ inch. Ring 83 has a length of approximately ¼ inch, as shown in FIG. 15. In keeping with my invention, a plurality of fiber optic cables 84 are provided with ends 85 to fit within and illuminate the ring 83 of the peep sight 80. In one preferred embodiment, the ends 85 of eight fiber optic cables 84 are equally spaced around the circular ring 83. It is contemplated that the peep sight can alternatively be illuminated with a chemiluminescent material, an illuminable liquid, a light emitting diode (LED), an incandescent light or the like . The peep sight 80 is mounted to the second mounting plate 55. The shaft is inserted through one of the holes 56 in the second mounting plate 55. The nuts 82 adjustably secure the shaft 85 in place. The user can vary an effective length of the shaft 81.

In one preferred embodiment, a variable resistor 90 is provided in electrical communication with a LED 92, as shown in FIG. 4. The LED 92, in turn, lights the fiber optic cables 73 and 84. A switch 91 is provided to turn the variable resistor on and off. The switch 90 can be a lever, knob, dial or the like without departing from the broad aspects of the invention. The same switch 91 can also be used to vary the resistance of the variable resistor 90, such that switch 91 is a combination on-off switch and variable resistor. Alternatively, separate switches (not shown) can be used for the on-off switch and for the variable resistor. Varying the resistance of the variable resistor varies energy provided to the LED 92, and, hence, the brightness of the LED 92. Varying the brightness of the LED 92, in turn, varies the brightness of the respective ends 74 and 85 of fiber optic cables 73 and 84. The variable resistor 90 and LED 92 cooperate to simultaneously and variably control the brightness of the pin sight 70 and peep sight 80. The variable resistor 90 can tone down the brightness to an acceptable level where the respective ends 74 and 85 of the fiber optic cables 73 and 84 are bright enough to enable the archer to see the pin sight 70 and peep sight 80, but not too bright as to detract from the archer's ability to see the target. The variable resistor 90 can be located on the connection plate 45. Mounting the variable resistor 90 on the connection plate 45 is advantageous because the archer can reach the variable resistor 90 with his or her thumb even when an arrow is drawn, in order to increase or decrease the intensity of the light as conditions warrant. The variable resistor 90 can be a rheostat, a potentiometer, or any other device capable of varying the resistance of an electrical circuit.

Figure 4A:
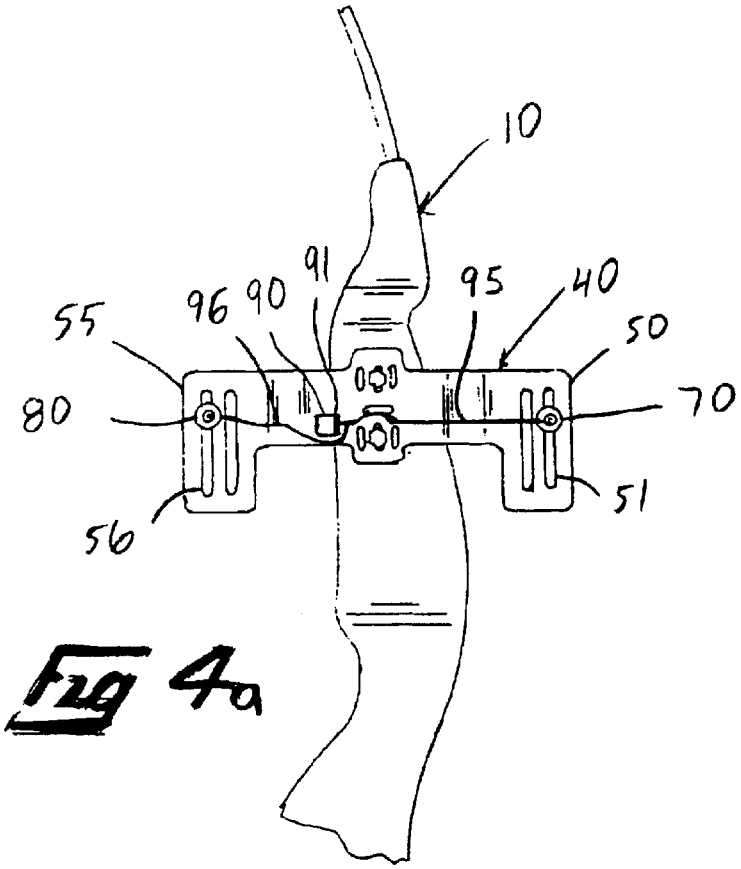
FIG. 4*a* is similar to FIG. 4, but shows alternative electric circuitry.

A different preferred embodiment is shown in FIG. 4*a*. The variable resistor 90 houses batteries (not shown). A switch 91 varies the amount of current that can pass through wires 95 and 96 to contacts (not shown) on the first and second mounting plates 50 and 55, respectively. Pin sight 70 is received within hole 51 and is in electrical communication with the contact on the first mounting plate 50. Peep sight 80 is received within hole 56 and is in electrical communication with the contact on the second mounting plate 55. In this embodiment, both the pin sight 70 and the peep sight 80 each contain a separate LED. A single variable resistor 90 simultaneously controls the brightness of the LEDs in both the pin sight 70 and peep sight 80. However, it is understood that separate variable resistors could be used to independently control the brightness of the LEDs.

Figure 9:
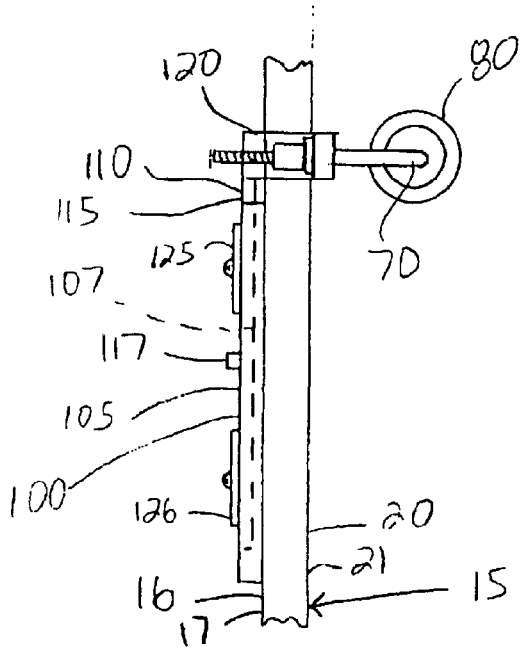
FIG. 9 is a front view taken along line 9—9 in FIG. 8.
Figure 10:
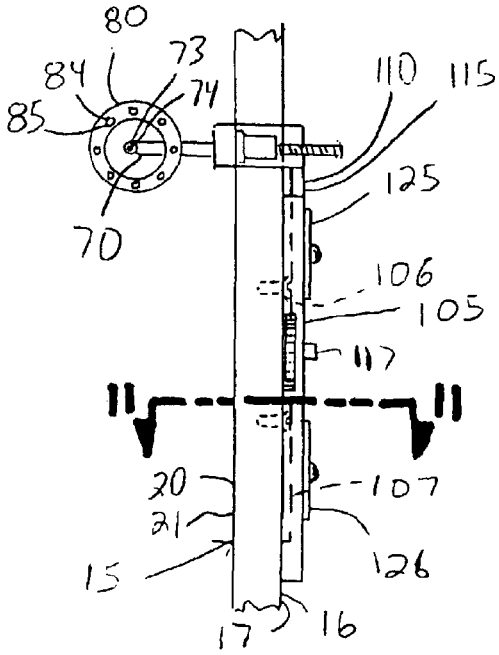
FIG. 10 is a rear view taken along line 10—10 in FIG. 8.
Figure 11:
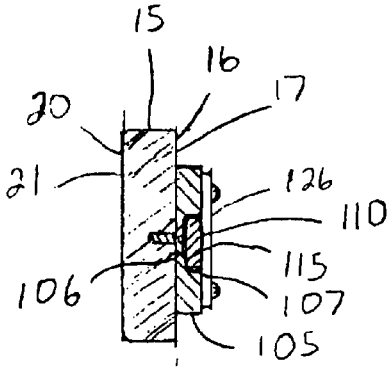
FIG. 11 is a cross sectional view taken along line 11—11 in FIG. 10.

In accordance with another aspect of the present invention, a second embodiment of a rifle type gun sight is provided, as shown in FIGS. 7–13. A bracket 100 has a front section 101 and an opposed rear section 102. The bracket 100 includes a connection plate 105 with holes 106 therethrough can be connected to the attaching section 15 of the bow 10. The connection plate 105 has a curved channel 107 formed therein, on its outer side. The curved channel 107 has a curvature with a radius approximately equal to the length of an adult human arm, or approximately between 18 and 36 inches. As shown in FIGS. 10 and 11, the holes 106, which are preferably slots, are aligned with holes 18 that are predrilled into the right side 16 of the attaching section 15 of the bow 10. Flat head screws are preferably used to connect the connection plate 105 to the right side 16 of the attaching section 15 of the bow 10. In this regard, the screw heads do not extend into the curved channel 107 of the connection plate 105.

Figure 8:
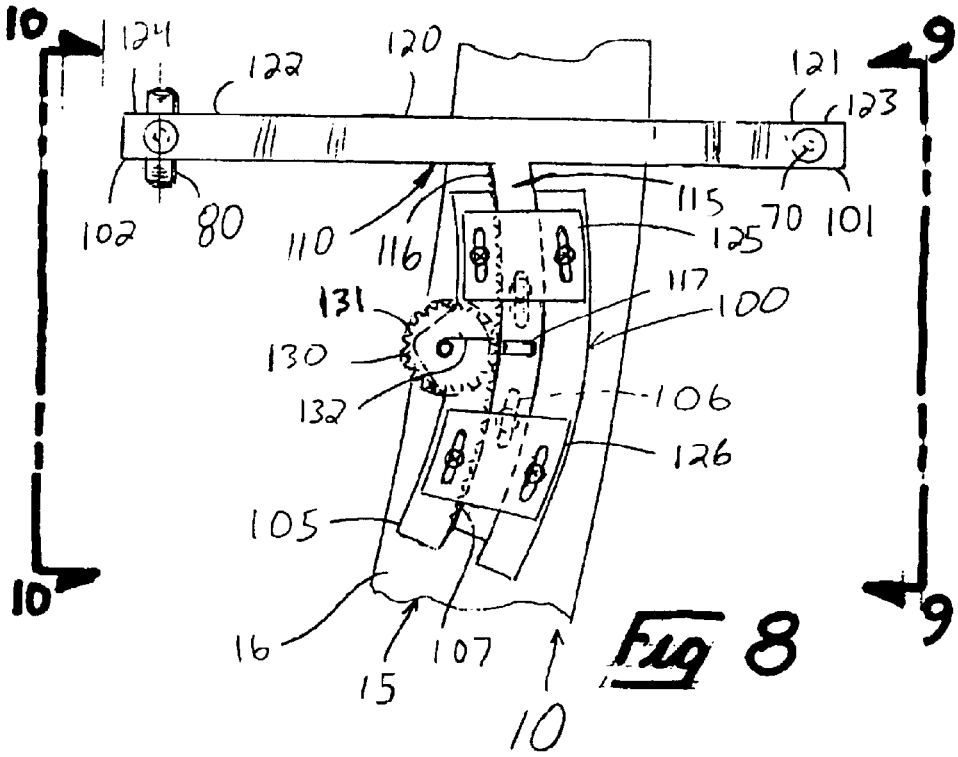
FIG. 8 is a side view of the alternative embodiment of the bracket shown in FIG. 7.

The bracket 100 also includes an aiming piece 110. The aiming piece 110 has a carriage slide 115 and a mounting beam 120, as shown in FIG. 8. The carriage slide 115 and mounting beam 120 are preferably a single integral piece. The carriage slide 115 and curved channel 107 are like-shaped. Carriage slide 115 has a concave side and a convex side. The carriage slide 115 is received within the curved channel 107 such that the connection plate 105 supports the aiming piece 110. Teeth 116 are on the concave side of the carriage slide 115. A range adjustment stop 117 is on the carriage slide 115.

The mounting beam 120 is on top of the carriage slide 115. The mounting beam 120 can have any of several cross-sectional shapes, such as circular or rectangular. The mounting beam 120 has a forward end 121 and a rearward end 122. The forward end 121 comprises a first mounting plate 123, and the rearward end 122 comprises a second mounting plate 124. In accordance with a further aspect of the present invention, the first mounting plate 123 and second mounting plate 124 are preferably coplanar and are offset from the remainder of the bracket 100. The first and second mounting plates 123 and 124 are preferably generally located in the second plane 21 defined by the left side 20 of the attaching section 15 of the bow 10 when the connection plate 105 is mounted to the right side 16 of the attaching section 15 of the bow 10. To accomplish this, the mounting beam 120 is a bent beam The mounting beam 120 is bent near its forward and rearward ends 121 and 122, respectively, as shown in FIGS. 7–10.

Holes 128 and 129 are through the first and second mounting plates 123 and 124, respectively. The holes 128 and 129 are preferably square or rectangular, but can have a different shape, such as circular without departing from the broad aspects of the invention. The pin sight 70 is received within hole 128 in the first mounting plate 123. The peep sight 80 is received within hole 129 in the second mounting plate 124. The rectangular shape of holes 128 and 129 ensures that the pin sight 70 and peep sight 80 are aligned properly with respect to the bracket 100.

A finger actuatable piece, such as a thumb wheel 130, is in operative association with said carriage slide, such that manipulation of the thumb wheel 130 causes movement of the carriage slide 115 within the curved channel 107. The thumbwheel 130 has teeth 131 that engage and interact with the teeth 116 of the carriage slide 115. A biasing mechanism, such as a spring clip 132, is provided. The spring clip 132 is anchored to the thumb wheel and is biased towards a straight position, as shown in FIG. 8. The spring clip 132 must flex in order for it to pass over the teeth 116 of the carriage slide 115. In this regard, the force due to gravity alone is insufficient to cause the spring clip 132 to flex enough to pass over teeth 116. Yet, the bias in the spring clip 132 is small enough that the archer can easily overcome it and manipulate the thumb wheel 130 to move the carriage slide 115 up and down within the curved channel 107. One alternative to a thumb wheel 130 with teeth 131 is a friction wheel (not shown) in which case the carriage slide 115 does not have teeth 116.

An upper cover 125 and a lower cover 126 are provided, and are connected to the connection plate 105 with screws or the like. The covers 125 and 126 have slots therethrough to allow the placement of the covers 125 and 126 to be adjusted with respect to the connection plate 105. The covers 125 and 126 serve more than one purpose. First, the covers function to retain the carriage slide 115 within the connection plate channel 107. Further the covers 125 and 126 function as adjustable range stops, such that the covers 125 and 126 limit the travel of the carriage slide 115 within the curved channel 107, as shown in FIGS. 8–10. The range adjustment stop 117 on the carriage slide 115 selectably abuts either cover 125 or 126 to limit the travel of the carriage slide 115 within the curved channel 107. As an example, the upper cover 125 can be adjusted such that range adjustment stop 117 abuts the upper cover 125 when the sight 100 is preset for 10 yards. Further, the lower cover 126 can be adjusted such that range adjustment stop 117 abuts the lower cover 126 when the sight 100 is preset for 30 yards. To aim for 20 yards, the range adjustment stop 117 would be positioned intermediate between the upper cover 125 and lower cover 126.

Figure 12:
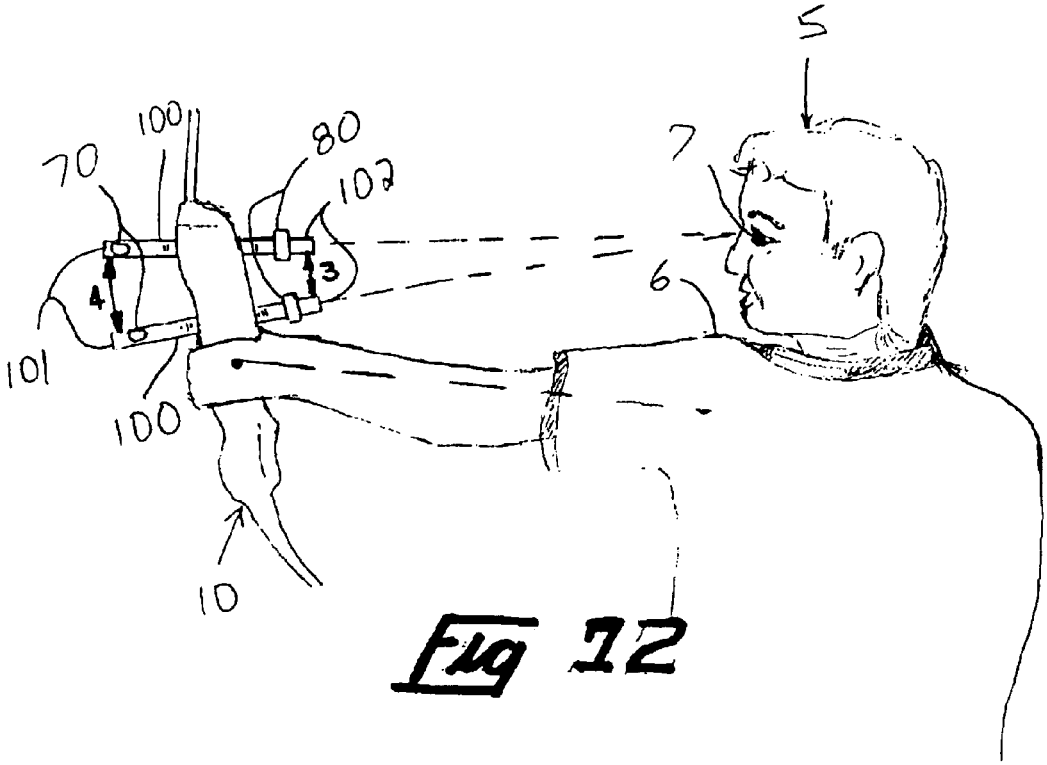
FIG. 12 is a diagram showing the ratio of movement of the pin sight and peep sight in the alternative bracket embodiment.

It is understood that the mounting beam 120 moves up and down as the carriage slide 115 moves up and down. Hence, the pin sight 70 and peep sight 80 that are connected to the first and second mounting plates 123 and 124, respectively, simultaneously move up and down. The pin sight 70 and peep sight 80 move up and down in respective arcuate paths with the center of rotation approximately at the archer's shoulder 6. Given a distance between the pin sight 70 and peep sight 80 of approximately 7 inches center to center, and a typical distance between the peep sight 80 and the archer's shoulder 6 of approximately 21 inches, every movement of 1 inch up or down by the pin sight 70 is met with a simultaneous ¾ inch movement by the peep sight 80, as shown in FIG. 12. Hence, it is apparent that the archer's shoulder 6 remains at the center of rotation when the carriage slide 115 moves up or down within the curved channel 107 of the connection plate 105. The arcuate paths that the pin sight 70 and peep sight 80 travel are designed to approximate the path of a human arm swing. The dimensions and distances herein described can vary without departing from the broad aspects of the invention.

Figure 13A:
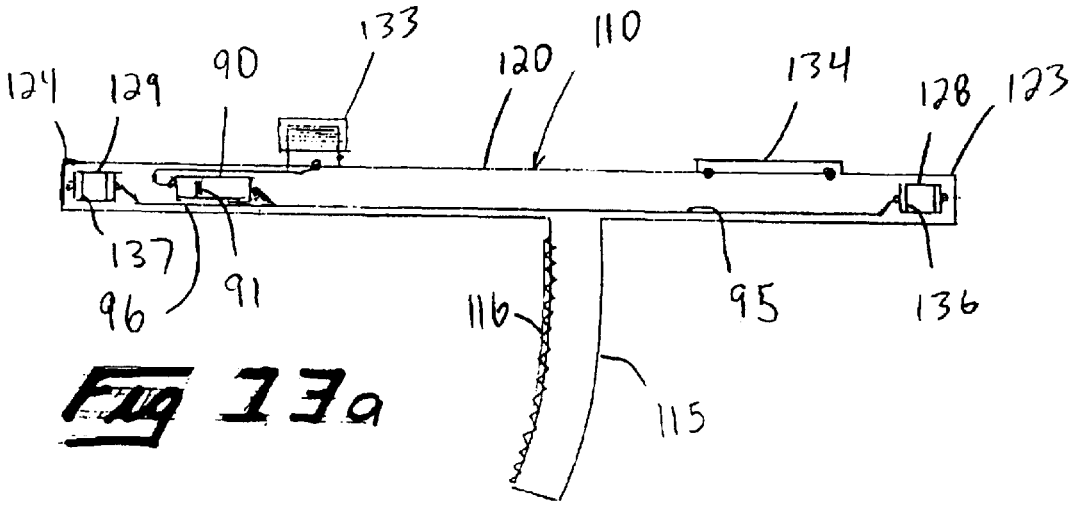
FIG. 13*a* is similar to FIG. 13, but shows alternative electric circuitry.
Figure 13:
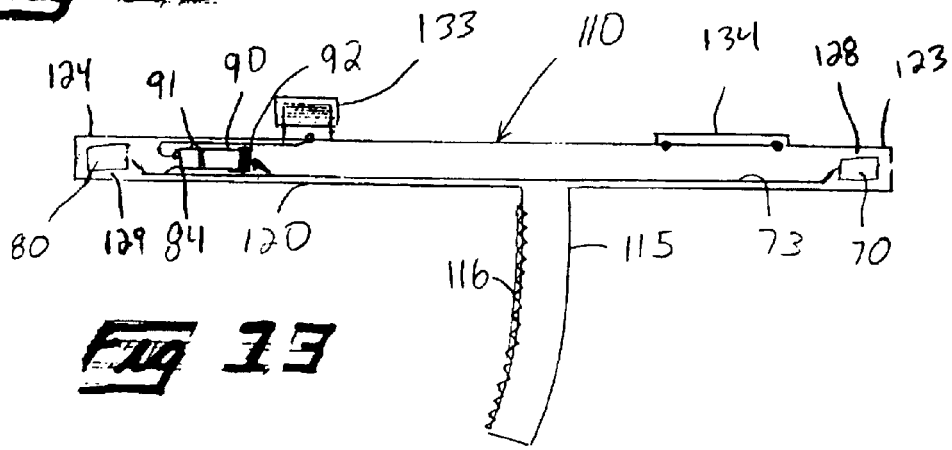
FIG. 13 is a diagram of the alternative bracket embodiment showing the use of a single variable resistor and circuitry.

In one embodiment, shown in FIG. 13, a single variable resistor 90 with a switch 91 can be wired to an LED 92. The LED 92 simultaneously illuminates the fiber optic cables 73 and 84 of the pin sight 70 and peep sight 80, respectively. The variable resistor 90 is positioned where the archer's thumb can manipulate it, even when an arrow is drawn. A battery compartment 133 is provided to house batteries (not shown) that supply power to energize the LED. An optional solar cell 134 similar to the solar cells commonly used in hand-held calculators is also shown, for recharging the batteries.

A further preferred embodiment is shown in FIG. 13*a*. The variable resistor 90 varies the amount of electric current that can flow from batteries (not shown) housed in the battery compartment 133 through wires 95 and 96 to electric contacts 136 and 137 located on the first and second mounting plates 123 and 124, respectively. The contacts 136 and 137 are preferably housed within holes 128 and 129, respectively. Pin sight 70 is received within hole 128 and is in contact with contact 136. Peep sight 80 is received within hole 129 and is in contact with contact 137. The variable resistor 90 is hence in electrical communication with the LEDs in both the pin sight 70 and peep sight 80 to simultaneously vary the brightness of the respective LEDs.

In use, the archer 5 aims the bow 10 by aligning the center of the peep sight 80, the pin sight 70 and the target with his or her eye 7. Hence, a direct line of sight to the target is provided. In the preferred embodiments described above, the pin sight 70 and peep sight 80 are preferably separated by approximately 7 inches on center. However, it is understood that the distance between the pin sight 70 and peep sight 80 can change, and the accuracy of the sight increases as the distance between the pin sight 70 and peep sight 80 increases.

The brackets 40 and 100 described above are preferably made of high strength plastic. In this regard, the circuitry is preferably embedded within the brackets 40 and 100. As an alternative, the electric circuitry could be comprised of a printed circuit (not shown) without departing from the broad aspects of the invention.

Further, as an additional alternative, the brackets 40 and 100 could be completely or partially made of metal. In this regard, certain parts of the bracket 40 or 100 could be part of the electric circuitry.

The preferred fight source, as described above, is a LED 92. However, it is understood that an incandescent bulb, a laser, or any other type of light source could be used without departing from the broad aspects of the invention.

As a still further alternative embodiment, the pin sight 70 can have a circular casing (not shown) and be fitted with cross hairs (not shown). Also, the peep sight 80 could include cross hairs (not shown).

Thus it is apparent that there has been provided, in accordance with the invention, a rifle type sight for an archery bow that fully satisfies the objects, aims and advantages as set forth above. While the invention has been described in conjunction with specific embodiments therof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A rifle-type sight assembly for mounting to a bow comprising:

a. a bracket with a bracket front section and a bracket rear section, said bracket being mountable to a bow;

b. a pin sight connected to said bracket front section;

c. a first fiber optic cable having a first illuminable end for illuminating said pin sight;

d. a peripherally and variably illuminated rear peep sight is in alignment with said pin sight;

e. a plurality of second fiber optic cables having respective second illuminable ends for illuminating said peripherally and variably illuminated rear peep sight; and f. a light source for providing light to at least one of said first fiber optic cable and said plurality of second fiber optic cables.

2. The sight assembly of claim 1 wherein said light source provides light to each of said first fiber optic cable and said plurality of second fiber optic cables.

3. The sight assembly of claim 2 wherein:

a. said first end of said first fiber optic cable and said respective second ends of said plurality of second fiber optic cables are variably illuminable; and b. a variable resistor variably controls said light source to thereby control the brightness of said respective ends of said first fiber optic cable and said plurality of second fiber optic cables.

4. The sight assembly of claim 1 wherein:

a. said light source provides light to said first fiber optic cable; and b. said sight assembly further comprises a second light source for providing light to said plurality of second fiber optic cables.

5. The sight assembly of claim 4 wherein:

a. said first end of said first fiber optic cable and said respective second ends of said plurality of second fiber optic cables are variably illuminable; and b. a variable resistor variably controls said light source and said second light source to thereby control the brightness of said respective ends of said first fiber optic cable and said plurality of second fiber optic cables.

6. The sight assembly of claim 1 wherein a. said plurality of second fiber optic cables comprises eight cables; and b. said respective second ends of said plurality of second fiber optic cables are arranged in a generally circular pattern.

7. The sight assembly of claim 1 wherein:

a. said bracket comprises a connection plate defining a first plane and being mountable to a first side of the bow;

b. said bracket front section comprises a first mounting plate connected to said connection plate and being at said front of said bracket, said first mounting plate lying in a second plane; and c. said bracket rear section comprises a second mounting plate connected to said connection plate and being at said rear of said bracket, said second mounting plate being generally coplanar with said first mounting plate.

8. The sight assembly of claim 7 wherein:

a. said first mounting plate has a first slot therethrough so that said pin sight is adjustably mountable to said first mounting plate;

b. said second mounting plate has a second slot therethrough so that said peep sight is adjustably mountable to said second mounting plate; and c. said connection plate has a third slot therethrough so that said connection plate is adjustably mountable to a section of the bow to which the connection plate is mounted.

9. The sight assembly of claim 7 wherein connection plate has a curved channel formed therein and said bracket further comprises an aiming piece having:

a. a carriage slide received within said curved channel of said connection plate; and b. a mounting beam on said carriage slide and having said bracket front section and said bracket rear section.

10. The sight assembly of claim 9 further comprising a finger actuatable piece in operative association with said carriage slide, wherein manipulation of said finger actuatable piece causes said carriage slide, said mounting beam, said pin sight and said peripherally and variably illuminated rear peep sight to simultaneously move.

11. The sight assembly of claim 10 wherein said pin sight moves 1 inch for every simultaneous ¾ inch movement of said peripherally and variably illuminated rear peep sight.

12. The sight assembly of claim 9 wherein said curved channel of said connection plate has a radius approximately equal to between 18 and 36 inches.

13. An apparatus for mounting to an archery bow comprising a bracket comprising:

a. a connection plate mountable to a bow and lying in a first plane;

b. a first mounting section supported by and forward of said connection plate, said first mounting section being offset from said connection plate by a distance at least equal to the width of a section of a bow to which the apparatus is mounted to and lying in a second plane; and c. a second mounting section supported by and rearward of said connection plate, said second mounting section being generally coplanar with said first mounting section wherein said connection plate defines a curved channel; a carriage slide is received within said curved channel of said connection plate; a mounting beam having said first and said second mounting sections is on said carriage slide; and a thumbwheel is in operative association with said carriage slide, wherein said thumbwheel is rotatable in a plane that is parallel to said first plane and about a fixed axis.

14. The apparatus of claim 13 further comprising:

a. a pin sight mounted to said first mounting section; and b. a peep sight mounted to said second mounting section.

15. The apparatus of claim 14 further comprising:

a. means for providing light;

b. a first fiber optic cable having a first end, said first end of said first fiber optic cable illuminating said pin sight in response to energizing said means for providing light; and c. a plurality of second fiber optic cables having respective second ends, said second ends of said respective second fiber optic cables illuminating said peep sight in response to energizing said means for providing light.

16. The apparatus of claim 15 wherein said means for providing light comprises:

a. a first LED for providing light to said first fiber optic cable; and b. a second LED for providing light to said plurality of second fiber optic cables.

17. The apparatus of claim 15 wherein said means for providing light comprises a single LED for providing light to both said first fiber optic cable and said plurality of second fiber optic cables.

18. The apparatus of claim 15 further comprising a variable resistor for communicating with said means for providing light to simultaneously control the illumination of said first end of said first fiber optic cable and said respective second ends of said plurality of second fiber optic cables.

19. The apparatus of claim 15 wherein said plurality of second fiber optic cables are generally arranged in circular pattern.

20. The apparatus of claim 13 further comprising:

a. a pin sight mounted to said first mounting section; and b. a peep sight mounted to said second mounting section.

21. The apparatus of claim 20 further comprising:

a. means for providing light on said apparatus;

b. a first fiber optic cable having a first end, said first end of said first fiber optic cable illuminating said pin sight in response to energizing said means for providing light; and c. a plurality of second fiber optic cables having respective second ends, said second ends of said respective second fiber optic cables illuminating said peep sight in response to energizing said means for providing light.

22. The apparatus of claim 21 further comprising a variable resistor for communicating with said means for providing light to simultaneously control the illumination of said first end of said first fiber optic cable and said respective second ends of said second fiber optic cables.

23. The apparatus of claim 21 wherein said plurality of second fiber optic are generally arranged in circular pattern.

24. A sight assembly for use with an archery bow comprising a bracket having:

a. a connection plate lying in a first plane having a curved channel formed therein;

b. an aiming piece comprising:

i. a carriage slide received and movable within said curved channel of said connection plate; and ii. a mounting beam on said carriage slide having a forward end and a rearward end that simultaneously move as said carriage slide moves in relation to said connection plate; and c. a finger actuatable piece connected to said connection plate for selectably moving said carriage slide within said curved channel of said connection plate, wherein said finger actuatable piece is rotatable in a plane that is generally parallel to said first plane and about a fixed axis.

25. The sight assembly of claim 24 wherein said curved channel of said connection plate has a radius approximately equal to between 18 and 36 inches.

26. The sight assembly of claim 24 further comprising:

a. a pin sight on said forward end of said mounting beam; and b. a peep sight on said rearward end of said mounting beam.

27. The sight assembly of claim 26 wherein said pin sight moves 1 inch for every corresponding simultaneous ¾ inch movement of said peep sight.

28. The sight assembly of claim 26 wherein:

a. at least one source of light is mounted on said aiming piece;

b. a first end of a first fiber optic cable illuminates said pin sight in response to energizing said at least one source of light; and c. a plurality of second ends of a plurality of second fiber optic cables illuminate said peep sight in response to energizing said at least one source of light and are arranged in a circular pattern.

29. The sight assembly of claim 28 wherein said at least source of light provides light to said first fiber optic cable and said plurality of second fiber optic cables.

30. The sight assembly of claim 28 wherein separate light sources provide light to said first fiber optic cable and said plurality of second fiber optic cables, respectively.

31. The sight assembly of claim 28 wherein a variable resistor communicates with said at least one source of light to simultaneously vary the brightness of said first end of said first fiber optic cable and said respective second ends of said plurality of second fiber optic cables.

32. The sight assembly of claim 24 wherein:

a. said carriage slide further comprises first teeth; and b. said finger actuatable piece is a thumbwheel, wherein said thumbwheel comprises second teeth that engage said first teeth of said carriage slide.

33. The sight assembly of claim 32 wherein said thumb wheel further comprises a spring clip, said spring clip biasing against movement of said carriage slide within said curved channel of said connection plate.

34. The sight assembly of claim 24 wherein said forward end and said rearward end of said mounting beam generally lie in a plane defined by a second side of an attaching section of a bow when said connection plate is mounted to a first side of the bow.

35. In combination:

a. a bow having a first side lying in a first plane and an opposed second side lying in a second plane; and b. a sight assembly comprising a bracket with;

i. a connection plate connected to said bow first side and lying in said first plane;

ii. a first leg connected to said connection plate and forward of said connection plate;

iii. a first mounting plate connected to said first leg and offset from and parallel to said connection plate and lying in said second plane;

iv. a second leg connected to said connection plate rearward of said connection plate; and V. a second mounting plate generally coplanar with said first mounting plate a pin sight connected to said first mounting plate, and a variably illuminable peep sight connected to said second mounting plate, wherein said pin sight and said peep sight are alignable in a direct line of sight on a target.

36. The of combination of claim 35 further comprising:

a. a first fiber optic cable for illuminating said pin sight;

b. a plurality of second fiber optic cables for illuminating said peep sight; and c. at least one light source for providing light to at least one of said first fiber optic cable and said plurality of second fiber optic cables.

37. The sight assembly of claim 40 wherein said at least one light source provides light to both said first fiber optic cable and said plurality of said second fiber optic cables.

38. The sight assembly of claim 36 further comprising a variable resistor that cooperates with said light source for simultaneously controlling the brightness in said first fiber optic cables and said plurality of said second fiber optic cables.

39. A method of aiming a bow comprising the steps of:

a. providing a bow with a first side lying in a first plane and an opposed second side lying in a second plane;

b. providing a bracket having a connection plate and first and second mounting sections;

c. mounting the bracket to the bow wherein the connection plate lies in the first plane and the first and the second mounting sections lie in the second plane;

d. mounting a pin sight to the first mounting section;

e. mounting a variably illuminable peep sight to the second mounting section; and f. aligning the pin sight and the peep sight in a direct line of sight on a target.

40. The method of claim 39 wherein the step of providing a bracket comprises the step of:

a. providing a connection plate with a curved channel formed therein; and b. providing a carriage slide for being in operative association with the curved channel of the connection plate and for supporting the first and the second mounting sections.

41. The method of claim 40 further comprising the step of providing a finger actuatable piece for manipulating the carriage slide within the curved channel of the connection plate for aiming the bow at different distances, wherein said finger actuatable piece operates in a plane that is parallel to the first plane of the first side of the bow.

42. A rifle-type sight assembly for mounting to a bow comprising:

a. a bracket comprising:

i. a connection plate defining a first plane and being mountable to a first side of a bow and having a curved channel formed therein;

ii. an aiming piece comprising:

1. a carriage slide receivable within said curved channel;

2. a mounting beam connected to said carriage slide;

3. a first mounting plate lying in a second plane at a second side of the bow when said connection plate is mounted to the first side of the bow; and 4. a second mounting plate being generally coplanar with said first mounting plate; and iii. a finger actuatable piece in operative association with said carriage slide, wherein:

1. manipulation of said finger actuatable piece causes said carriage slide, said mounting beam, said first mounting plate and said second mounting plate to simultaneously move; and 2. said finger actuable piece is rotatable in a plane that is generally parallel to said first plane and about a fixed axis; and b. a pin sight connected to said bracket front section;

c. a first fiber optic cable having a first illuminable end for illuminating said pin sight;

d. a peep sight connected to said bracket rear section;

e. a plurality of second fiber optic cables having respective second illuminable ends for illuminating said peep sight; and f. a light source for providing light to at least one of said first fiber optic cable and said plurality of second fiber optic cables.

* * * * *